US012305254B2

(12) United States Patent
Kariya et al.

(10) Patent No.: US 12,305,254 B2
(45) Date of Patent: May 20, 2025

(54) STEEL SHEET FOR CANS AND METHOD OF PRODUCING SAME

(71) Applicant: JFE STEEL CORPORATION, Tokyo (JP)

(72) Inventors: Nobusuke Kariya, Tokyo (JP); Fusae Shiimori, Tokyo (JP); Katsumi Kojima, Tokyo (JP); Daisuke Otani, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 598 days.

(21) Appl. No.: 17/596,677

(22) PCT Filed: Jun. 8, 2020

(86) PCT No.: PCT/JP2020/022579
§ 371 (c)(1),
(2) Date: Dec. 16, 2021

(87) PCT Pub. No.: WO2020/261965
PCT Pub. Date: Dec. 30, 2020

(65) Prior Publication Data

US 2022/0316023 A1 Oct. 6, 2022

(30) Foreign Application Priority Data

Jun. 24, 2019 (JP) ..... 2019-116706

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/28*** | (2006.01) |
| ***C22C 38/32*** | (2006.01) |

(52) U.S. Cl.
CPC ..... *C21D 9/46* (2013.01); *C21D 8/0226* (2013.01); *C21D 8/0236* (2013.01); *C21D 8/0273* (2013.01); *C22C 38/001* (2013.01); *C22C 38/002* (2013.01); *C22C 38/02* (2013.01); *C22C 38/04* (2013.01); *C22C 38/06* (2013.01); *C22C 38/28* (2013.01); *C22C 38/32* (2013.01); *C21D 2211/005* (2013.01)

(58) Field of Classification Search
CPC ..... C21D 9/46; C21D 8/0226; C21D 8/0221; C21D 8/0236; C21D 8/0247; C21D 8/0263; C21D 8/0273
See application file for complete search history.

(56) References Cited

U.S. PATENT DOCUMENTS

| | | | | |
|---|---|---|---|---|
| 6,221,180 | B1 | 4/2001 | Tosaka et al. | |
| 8,911,567 | B2 | 12/2014 | Ogawa et al. | |
| 10,415,111 | B2 | 9/2019 | Tada et al. | |
| 10,837,076 | B2 | 11/2020 | Saito et al. | |
| 2010/0116832 | A1* | 5/2010 | Nishihara | C21D 9/46 148/330 |
| 2014/0238555 | A1 | 8/2014 | Funakawa et al. | |
| 2020/0255915 | A1 | 8/2020 | Lian et al. | |

FOREIGN PATENT DOCUMENTS

| | | | | |
|---|---|---|---|---|
| CN | 102597292 | A | | 7/2012 |
| CN | 102912227 | A | | 2/2013 |
| CN | 103917679 | A | | 7/2014 |
| CN | 107109556 | A | | 8/2017 |
| CN | 109423577 | A | | 3/2019 |
| JP | H08325670 | A | | 12/1996 |
| JP | H0953123 | A | | 2/1997 |
| JP | 2001089828 | A | | 4/2001 |
| JP | 2001107186 | A | * | 4/2001 |
| JP | 2004183074 | A | | 7/2004 |
| WO | 2015146136 | A1 | | 10/2015 |
| WO | 2015166653 | A1 | | 11/2015 |
| WO | 2016157878 | A1 | | 10/2016 |

OTHER PUBLICATIONS

Mar. 24, 2022, Office Action issued by the China National Intellectual Property Administration in the corresponding Chinese Patent Application No. 202080043123.7 with English language search report.

Sep. 1, 2020, International Search Report issued in the International Patent Application No. PCT/JP2020/022579.

* cited by examiner

*Primary Examiner* — Ricardo D Morales

(74) *Attorney, Agent, or Firm* — KENJA IP LAW PC

(57) ABSTRACT

Provided is a steel sheet for cans with high strength and sufficiently high formability particularly as a material for a can body with a neck portion. The steel sheet for cans of the present disclosure has a chemical composition containing, in mass %, C: 0.010% to 0.130%, Si: 0.04% or less, Mn: 0.10% to 1.00%, P: 0.007% to 0.100%, S: 0.0005% to 0.0090%, Al: 0.001% to 0.100%, N: 0.0050% or less, Ti: 0.0050% to 0.1000%, B: 0.0005% to less than 0.0020%, and Cr: 0.08% or less, where $0.005 \leq (Ti^*/48)/(C/12) \leq 0.700$ is satisfied; and a microstructure with a proportion of non-recrystallized ferrite of 3% or less, wherein an upper yield stress is 550 MPa to 620 MPa.

4 Claims, No Drawings

STEEL SHEET FOR CANS AND METHOD OF PRODUCING SAME

TECHNICAL FIELD

The present disclosure relates to a steel sheet for cans and a method of producing the same.

BACKGROUND

There has been a demand for cost reduction in production of bodies and lids of food cans and beverage cans using steel sheets, and it is promoted, as a measure, to reduce the thickness of the steel sheets to be used to reduce the material costs. The steel sheets whose thickness is to be reduced are steel sheets used for can bodies of two-piece cans formed by drawing, can bodies of three-piece cans formed by cylinder forming, and can lids. Simply reducing the thickness of the steel sheets decreases the strength of can bodies and can lids, so that steel sheets for high-strength ultra-thin cans are desired for parts such as can bodies of draw-redraw (DRD) cans and welded cans.

The steel sheets for high-strength ultra-thin cans are produced with a Double Reduce method (hereinafter also referred to as "DR method"), in which secondary cold rolling with rolling reduction of 20% or more is performed after annealing. Steel sheets produced with the DR method (hereinafter also referred to as "DR material") have high strength but low total elongation (poor ductility) and poor formability.

In a can body, the diameter of a can mouth is sometimes designed to be smaller than the diameter of other parts in order to reduce the material costs of a lid. The process of reducing the diameter of a can mouth is called neck forming, in which die neck forming using a press mold or spin neck forming using a rotating roller is performed on a can mouth to reduce the diameter of the can mouth and form a neck portion. When the material, such as the DR material, has high strength, dents due to buckling caused by local deformation of the material occur in the neck portion. Dents should be avoided because they impair the appearance of cans and decrease the commercial value. In addition, reducing the thickness of the material makes it easier to cause dents in the neck portion.

The DR material, which is generally used as a steel sheet for high-strength ultra-thin cans, is poor in ductility, and it is usually difficult to form the DR material into a neck portion of a can body. Therefore, when the DR material is used, a product is obtained after many times of press mold adjustment and multi-stage forming. Further, because the DR material is strain hardened through secondary cold rolling to further increase the strength of the steel sheet, local deformation may occur during forming of the DR material as a result of the strain hardening being unevenly introduced into the steel sheet depending on the accuracy of the secondary cold rolling. This local deformation should be avoided because it causes dents in a neck portion of a can body.

To avoid such disadvantages of the DR material, methods of producing a high strength steel sheet using various strengthening methods have been proposed. JP H8-325670 A (PTL1) proposes a steel sheet having excellent deep drawability and flange formability during the production of cans and excellent surface shape after the production of cans by achieving high strength through refinement of the steel microstructure and optimizing the steel microstructure. JP 2004-183074 A (PTL 2) proposes a steel sheet for thin-walled deep-drawn ironed cans, which is soft during forming but can obtain a hard state through heat treatment after the forming by adjusting Mn, P and N to appropriate amounts in low-carbon steel. JP 2001-89828 A (PTL 3) proposes a steel sheet for three-piece cans having excellent workability in welded portion in which, for example, occurrence of neck wrinkles is suppressed and flange cracking resistance is improved by controlling the particle size of oxide-based inclusions. WO 2015/166653 (PTL 4) proposes a steel sheet for high-strength containers having a tensile strength of 400 MPa or more and elongation after fracture of 10% or more by increasing the N content to achieve high strength through solute N and controlling the dislocation density in the thickness direction of the steel sheet.

CITATION LIST

Patent Literature

PTL 1: JP H8-325670 A
PTL 2: JP 2004-183074 A
PTL 3: JP 2001-89828 A
PTL 4: WO 2015/166653

SUMMARY

Technical Problem

As mentioned above, it is necessary to secure strength to reduce the thickness of a steel sheet for cans. On the other hand, when a steel sheet is used as a material for a can body with a neck portion, the steel sheet is required to have high ductility. Further, it is necessary to suppress local deformation of a steel sheet to suppress the occurrence of dent in a neck portion of a can body. However, with respect to these properties, the above conventional technologies are inferior in any of strength, ductility (total elongation), uniform deformability, or formability of neck portion.

PTL 1 proposes a steel having high strength and good balance with ductility by refinement of the steel microstructure and optimization of the steel microstructure. However, PTL 1 does not take local deformation of a steel sheet into consideration, and it is difficult to obtain a steel sheet that satisfies the formability required for a neck portion of a can body with the production method described in PTL 1.

PTL 2 proposes that the strength properties of cans should be enhanced by refinement of the steel microstructure through P and aging through N. However, the method of strengthening a steel sheet by adding P described in PTL 2 tends to cause local deformation of the steel sheet, and it is difficult to obtain a steel sheet that satisfies the formability required for a neck portion of a can body with the technology described in PTL 2.

In PTL 3, the desired strength is obtained by refinement of crystal grains using Nb and B. However, the tensile strength of the steel sheet of PTL 3 is less than 540 MPa, and the strength of the steel sheet is inferior as a steel sheet for high-strength ultra-thin cans. Further, the addition of Ca and REM is also essential from the viewpoints of formability of welded portion and surface characteristics, and the technology of PTL 3 has a problem of deteriorating corrosion resistance. Furthermore, PTL 3 does not take local deformation of a steel sheet into consideration, and it is difficult to obtain a steel sheet that satisfies the formability required for a neck portion of a can body with the production method described in PTL 3.

PTL 4 evaluates pressure resistance by forming a can lid using a steel sheet for high strength containers with a tensile strength of 400 MPa or more and elongation after fracture of 10% or more. However, PTL 4 does not take the shape of a neck portion of a can body into consideration, and it is difficult to obtain a good neck portion of a can body with the technology described in PTL 4.

It could thus be helpful to provide a steel sheet for cans with high strength and sufficiently high formability particularly as a material for a can body with a neck portion, and a method of producing the same.

Solution to Problem

We thus provide the following.

[1] A steel sheet for cans, comprising a chemical composition containing (consisting of), in mass %, C: 0.010% or more and 0.130% or less, Si: 0.04% or less, Mn: 0.10% or more and 1.00% or less, P: 0.007% or more and 0.100% or less, S: 0.0005% or more and 0.0090% or less, Al: 0.001% or more and 0.100% or less, N: 0.0050% or less, Ti: 0.0050% or more and 0.1000% or less, B: 0.0005% or more and less than 0.0020%, and Cr: 0.08% or less, wherein, with $Ti^*=Ti-1.5S$, $0.005 \leq (Ti^*/48)/(C/12) \leq 0.700$ is satisfied, and the balance is Fe and inevitable impurities; and a microstructure with a proportion of non-recrystallized ferrite of 3% or less, wherein an upper yield stress is 550 MPa or more and 620 MPa or less.

[2] The steel sheet for cans according to [1], wherein the chemical composition further contains, in mass %, at least one selected from the group consisting of Nb: 0.0050% or more and 0.0500% or less, Mo: 0.0050% or more and 0.0500% or less, and V: 0.0050% or more and 0.0500% or less.

[3] A method of producing a steel sheet for cans, comprising a hot rolling process wherein a steel slab comprising a chemical composition containing (consisting of), in mass %, C: 0.010% or more and 0.130% or less, Si: 0.04% or less, Mn: 0.10% or more and 1.00% or less, P: 0.007% or more and 0.100% or less, S: 0.0005% or more and 0.0090% or less, Al: 0.001% or more and 0.100% or less, N: 0.0050% or less, Ti: 0.0050% or more and 0.1000% or less, B: 0.0005% or more and less than 0.0020%, and Cr: 0.08% or less, where, with $Ti^*=Ti-1.5S$, $0.005 \leq (Ti^*/48)/(C/12) \leq 0.700$ is satisfied, and the balance is Fe and inevitable impurities, is heated at 1200° C. or higher and subjected to rolling with a rolling finish temperature of 850° C. or higher to obtain a steel sheet, and the steel sheet is subjected to coiling at a temperature of 640° C. or higher and 780° C. or lower and then cooled at an average cooling rate of 25° C./h or higher and 55° C./h or lower from 500° C. to 300° C.; a cold rolling process wherein the steel sheet after the hot rolling process is subjected to cold rolling at rolling reduction of 86% or more; an annealing process wherein the steel sheet after the cold rolling process is held in a temperature range of 640° C. or higher and 780° C. or lower for 10 seconds or longer and 90 seconds or shorter, then the steel sheet is subjected to primary cooling to a temperature range of 500° C. or higher and 600° C. or lower at an average cooling rate of 7° C./s or higher and 180° C./s or lower, and subsequently the steel sheet is subjected to secondary cooling to 300° C. or lower at an average cooling rate of 0.1° C./s or higher and 10° C./s or lower; and a process wherein the steel sheet after the annealing process is subjected to temper rolling with rolling reduction of 0.1% or more and 3.0% or less.

[4] The method of producing a steel sheet for cans according to [3], wherein the chemical composition further contains, in mass %, at least one selected from the group consisting of Nb: 0.0050% or more and 0.0500% or less, Mo: 0.0050% or more and 0.0500% or less, and V: 0.0050% or more and 0.0500% or less.

Advantageous Effect

According to the present disclosure, it is possible to obtain a steel sheet for cans having high strength and sufficiently high forming accuracy particularly as a material for a can body with a neck portion.

DETAILED DESCRIPTION

The present disclosure will be described below based on embodiments. First, the chemical composition of a steel sheet for cans according to one embodiment of the present disclosure will be described. The unit in the chemical composition is "mass %", which is simply indicated as "%" unless otherwise specified.

C: 0.010% or More and 0.130% or Less

It is important for the steel sheet for cans of the present embodiment to have an upper yield stress of 550 MPa or more. To achieve this, it is important to utilize strengthening by precipitation by Ti-based carbides formed by containing Ti. The C content in the steel sheet for cans is important in utilizing the strengthening by precipitation by Ti-based carbides. When the C content is less than 0.010%, the effect of increasing the strength by strengthening by precipitation described above is reduced, and the upper yield stress is less than 550 MPa. Therefore, the lower limit of the C content is set to 0.010% and is preferably 0.015% or more. On the other hand, when the C content is more than 0.130%, hypo-peritectic cracking occurs in a cooling process during steelmaking, and ductility deteriorates due to excessively hardening of the steel sheet. Further, the ratio of non-recrystallized ferrite exceeds 3%, causing dents when the steel sheet is formed into a neck portion of a can body. Therefore, the upper limit of the C content is set to 0.130%. Furthermore, when the C content is 0.060% or less, the strength of a hot-rolled sheet is suppressed, the deformation resistance during cold rolling is further reduced, and surface defects are less likely to occur even if the rolling speed is increased. Therefore, the C content is preferably 0.060% or less from the viewpoint of ease of production. The C content is more preferably 0.015% or more and 0.060% or less.

Si: 0.04% or Less

Si is an element that increases the strength of steel by solid solution strengthening. To obtain this effect, the Si content is preferably 0.01% or more. However, when the Si content is more than 0.04%, corrosion resistance is significantly deteriorated. Therefore, the Si content is set to 0.04% or less. The Si content is preferably 0.03% or less. The Si content is more preferably 0.01% or more and 0.03% or less.

Mn: 0.10% or More and 1.00% or Less

Mn increases the strength of steel by solid solution strengthening. When the Mn content is less than 0.10%, an upper yield stress of 550 MPa or more cannot be secured. Therefore, the lower limit of the Mn content is set to 0.10%. On the other hand, when the Mn content is more than 1.00%, corrosion resistance and surface properties are deteriorated, and the proportion of non-recrystallized ferrite exceeds 3%, causing local deformation and deteriorating uniform deformability. Therefore, the upper limit of the Mn content is set to 1.00%. The Mn content is preferably 0.20% or more. The Mn content is preferably 0.60% or less. The Mn content is more preferably 0.20% or more and 0.60% or less.

P: 0.007% or More and 0.100% or Less

P is an element having high solid solution strengthening ability. To obtain such an effect, it is necessary to contain P at an amount of 0.007% or more. Therefore, the lower limit of the P content is set to 0.007%. On the other hand, when the P content is more than 0.100%, the steel sheet is excessively hardened, which decreases ductility and further deteriorates corrosion resistance. Therefore, the upper limit of the P content is set to 0.100%. The P content is preferably 0.008% or more. The P content is preferably 0.015% or less. The P content is more preferably 0.008% or more and 0.015% or less.

S: 0.0005% or More and 0.0090% or Less

The steel sheet for cans of the present embodiment obtains high strength through strengthening by precipitation by Ti-based carbides. S tends to form TiS with Ti. When TiS is formed, the amount of Ti-based carbides useful for strengthening by precipitation is reduced, and high strength cannot be obtained. In other words, when the S content is more than 0.0090%, a large amount of TiS is formed, and the strength decreases. Therefore, the upper limit of the S content is set to 0.0090%. The S content is preferably 0.0080% or less. On the other hand, a S content of less than 0.0005% leads to excessive desulfurization costs. Therefore, the lower limit of the S content is set to 0.0005%.

Al: 0.001% or More and 0.100% or Less

Al is an element contained as a deoxidizer, and Al is also useful in the refinement of steel. When the Al content is less than 0.001%, the effect as a deoxidizer is insufficient, which causes the occurrence of solidification defects and increases steelmaking costs. Therefore, the lower limit of the Al content is set to 0.001%. On the other hand, when the Al content is more than 0.100%, surface defects may occur. Therefore, the upper limit of the Al content is set to 0.100% or less. The Al content is preferably 0.010% or more and 0.060% or less, because Al can act better as a deoxidizer in this case.

N: 0.0050% or Less

The steel sheet for cans of the present embodiment obtains high strength through strengthening by precipitation by Ti-based carbides. N tends to form TiN with Ti. When TiN is formed, the amount of Ti-based carbides useful for strengthening by precipitation is reduced, and high strength cannot be obtained. Further, when the N content is too high, slab cracking is likely to occur in a lower straightening zone where the temperature is lowered during continuous casting. Therefore, the upper limit of the N content is set to 0.0050%. The lower limit of the N content is not specified. However, the N content is preferably more than 0.0005% from the viewpoint of steelmaking costs.

Ti: 0.0050% or More and 0.1000% or Less

Ti is an element that has high carbide-forming ability and is effective in precipitating fine carbides. This increases the upper yield stress. In the present embodiment, the upper yield stress can be adjusted by adjusting the Ti content. This effect is obtained when the Ti content is 0.0050% or more, so that the lower limit of the Ti content is set to 0.0050%. On the other hand, Ti causes an increase in the recrystallization temperature. Therefore, when the Ti content is more than 0.1000%, the proportion of non-recrystallized ferrite exceeds 3% during annealing at 640° C. to 780° C., and dents occur when the steel sheet is formed into a neck portion of a can body. Therefore, the upper limit of the Ti content is set to 0.1000%. The Ti content is preferably 0.0100% or more. The Ti content is preferably 0.0800% or less. The Ti content is more preferably 0.0100% or more and 0.0800% or less.

B: 0.0005% or More and Less than 0.0020%

B is effective in refining ferrite grains and increasing the upper yield stress. In the present embodiment, the upper yield stress can be adjusted by adjusting the B content. This effect is obtained when the B content is 0.0005% or more, so that the lower limit of the B content is set to 0.0005%. On the other hand, B causes an increase in the recrystallization temperature. Therefore, when the B content is 0.0020% or more, the proportion of non-recrystallized ferrite exceeds 3% during annealing at 640° C. to 780° C., and dents occur when the steel sheet is formed into a neck portion of a can body. Therefore, the B content is set to less than 0.0020%. The B content is preferably 0.0006% or more. The B content is preferably 0.0018% or less. The B content is more preferably 0.0006% or more and 0.0018% or less.

Cr: 0.08% or Less

Cr is an element that forms carbonitrides. Cr carbonitrides contribute to increasing the strength of steel, although their strengthening ability is lower than that of Ti-based carbides. From the viewpoint of sufficiently obtaining this effect, the Cr content is preferably 0.001% or more. However, when the Cr content is more than 0.08%, Cr carbonitrides are excessively formed, the formation of Ti-based carbides, which contribute most to the strengthening of the steel, is suppressed, and the desired strength cannot be obtained. Therefore, the Cr content is set to 0.08% or less.

$0.005 \leq (Ti^*/48)/(C/12) \leq 0.700$

The value of $(Ti^*/48)/(C/12)$ is important for obtaining high strength and suppressing local deformation during forming. As used herein, $Ti^*$ is defined as $Ti^*=Ti-1.5S$. Ti forms fine precipitates (Ti-based carbides) with C and contributes to increasing the strength of steel. The C that does not form Ti-based carbides exists in the steel as cementite or solute C. The solute C causes local deformation during working of the steel sheet, and dents occur when the steel sheet is worked into a neck portion of a can body. Further, Ti tends to combine with S to form TiS. When TiS is formed, the amount of Ti-based carbides useful for strengthening by precipitation is reduced, and high strength cannot be obtained. We found that by controlling the value of $(Ti^*/48)/(C/12)$, dents caused by local deformation during forming of the steel sheet can be suppressed while achieving high strength by Ti-based carbides, and completed the present disclosure. That is, when $(Ti^*/48)/(C/12)$ is less than 0.005, the amount of Ti-based carbides, which contribute to increasing the strength of the steel, is reduced, the upper yield stress is less than 550 MPa, the proportion of non-recrystallized ferrite exceeds 3%, and dents occur when the steel sheet is formed into a neck portion of a can body. Therefore, $(Ti^*/48)/(C/12)$ is set to 0.005 or more. On the other hand, when $(Ti^*/48)/(C/12)$ is more than 0.700, the proportion of non-recrystallized ferrite exceeds 3% during annealing at 640° C. to 780° C., and dents occur when the steel sheet is formed into a neck portion of a can body. Therefore, $(Ti^*/48)/(C/12)$ is set to 0.700 or less. $(Ti^*/48)/(C/12)$ is preferably 0.090 or more. $(Ti^*/48)/(C/12)$ is preferably 0.400 or less. $(Ti^*/48)/(C/12)$ is more preferably 0.090 or more and 0.400 or less.

The balance other than the above components is Fe and inevitable impurities.

The basic components of the present disclosure have been described above, and the present disclosure may appropriately contain the following elements as necessary.

Nb: 0.0050% or More and 0.0500% or Less

Nb, like Ti, is an element that has high carbide-forming ability and is effective in precipitating fine carbides. This increases the upper yield stress. In the present embodiment, the upper yield stress can be adjusted by adjusting the Nb content. This effect is obtained when the Nb content is 0.0050% or more. Therefore, when Nb is added, the lower limit of the Nb content is preferably 0.0050%. On the other hand, Nb causes an increase in the recrystallization temperature. Therefore, when the Nb content is more than 0.0500%, the proportion of non-recrystallized ferrite exceeds 3% during annealing at 640° C. to 780° C., and dents occur when the steel sheet is formed into a neck portion of a can body. Therefore, when Nb is added, the upper limit of the Nb content is preferably 0.0500%. The Nb content is more preferably 0.0080% or more. The Nb content is more preferably 0.0300% or less. The Nb content is still more preferably 0.0080% or more and 0.0300% or less.

Mo: 0.0050% or More and 0.0500% or Less

Mo, like Ti and Nb, is an element that has high carbide-forming ability and is effective in precipitating fine carbides. This increases the upper yield stress. In the present embodiment, the upper yield stress can be adjusted by adjusting the Mo content. This effect is obtained when the Mo content is 0.0050% or more. Therefore, when Mo is added, the lower limit of the Mo content is preferably 0.0050%. On the other hand, Mo causes an increase in the recrystallization temperature. Therefore, when the Mo content is more than 0.0500%, the proportion of non-recrystallized ferrite exceeds 3% during annealing at 640° C. to 780° C., and dents occur when the steel sheet is formed into a neck portion of a can body. Therefore, when Mo is added, the upper limit of the Mo content is preferably 0.0500%. The Mo content is more preferably 0.0080% or more. The Mo content is more preferably 0.0300% or less. The Mo content is still more preferably 0.0080% or more and 0.0300% or less.

V: 0.0050% or More and 0.0500% or Less

V is effective in refining ferrite grains and increasing the upper yield stress. In the present embodiment, the upper yield stress can be adjusted by adjusting the V content. This effect is obtained when the V content is 0.0050% or more. Therefore, when V is added, the lower limit of the V content is preferably 0.0050%. On the other hand, V causes an increase in the recrystallization temperature. Therefore, when the V content is more than 0.0500%, the proportion of non-recrystallized ferrite exceeds 3% during annealing at 640° C. to 780° C., and dents occur when the steel sheet is formed into a neck portion of a can body. Therefore, when V is added, the upper limit of the V content is preferably 0.0500%. The V content is more preferably 0.0080% or more. The V content is more preferably 0.0300% or less. The V content is still more preferably 0.0080% or more and 0.0300% or less.

Next, the mechanical properties of the steel sheet for cans of the present embodiment will be described.

Upper Yield Stress: 550 MPa or More and 620 MPa or Less

The upper yield stress of the steel sheet is set to 550 MPa or more in order to secure the denting strength, which is the strength against dents of a welded can, the pressure resistance of a can lid, and the like. On the other hand, when the upper yield stress of the steel sheet is more than 620 MPa, dents occur when the steel sheet is formed into a neck portion of a can body. Therefore, the upper yield stress of the steel sheet is set to 550 MPa or more and 620 MPa or less.

The yield stress can be measured with a metal material tensile test method specified in "JIS Z 2241:2011". The yield stress described above can be obtained by adjusting the chemical composition, the coiling temperature in a hot rolling process, the cooling rate in a cooling process after coiling in a hot rolling process, the rolling reduction in a cold rolling process, the soaking temperature and the holding time in an annealing process, the cooling rate in an annealing process, and the rolling reduction in a temper rolling process. Specifically, a yield stress of 550 MPa or more and 620 MPa or less can be obtained by setting the chemical composition as described above, setting the coiling temperature in a hot rolling process to 640° C. or higher and 780° C. or lower, setting the average cooling rate from 500° C. to 300° C. after coiling to 25° C./h or higher and 55° C./h or lower, setting the rolling reduction in a cold rolling process to 86% or more, in an annealing process, setting the holding time in a temperature range of 640° C. or higher and 780° C. or lower to 10 seconds or longer and 90 seconds or shorter, performing primary cooling to a temperature range of 500° C. or higher and 600° C. or lower at an average cooling rate of 7° C./s or higher and 180° C./s or lower and performing secondary cooling to 300° C. or lower at an average cooling rate of 0.1° C./s or higher and 10° C./s or lower, and setting the rolling reduction in a temper rolling process to 0.1% or more and 3.0% or less.

Next, the metallic structure of the steel sheet for cans of the present disclosure will be described.

Proportion of Non-Recrystallized Ferrite: 3% or Less

When the proportion of non-recrystallized ferrite in the metallic structure is more than 3%, dents occur due to local deformation during forming, for example, when forming the steel sheet into a neck portion of a can body. Therefore, the proportion of non-recrystallized ferrite in the metallic structure is set to 3% or less. Although the mechanism of occurrence of local deformation during forming is not clear, it is inferred that the presence of a large amount of non-recrystallized ferrite leads to the imbalance of the interaction between non-recrystallized ferrite and dislocation during forming, which causes the occurrence of dent. The proportion of non-recrystallized ferrite in the metallic structure is preferably 2.7% or less. The proportion of non-recrystallized ferrite in the metallic structure is preferably 0.5% or more, because the annealing temperature can be relatively low in this case. The proportion of non-recrystallized ferrite in the metallic structure is more preferably 0.8% or more.

The proportion of non-recrystallized ferrite in the metallic structure can be measured with the following method. After polishing a cross section in the thickness direction parallel to the rolling direction of the steel sheet, the cross section is etched with an etching solution (3 vol % nital). Next, an optical microscopy is used to observe an area from a position at a depth of ¼ sheet thickness (a position of ¼ sheet thickness in the thickness direction from the surface in the cross section) to a position of ½ sheet thickness in ten locations at 400 times magnification. Next, non-recrystallized ferrite is identified visually using micrographs taken by the optical microscopy, and the area ratio of non-recrystallized ferrite is determined by image interpretation. As used herein, the non-recrystallized ferrite is a metallic structure that is elongated in the rolling direction under an optical microscopy at 400 times magnification. The area ratio of non-recrystallized ferrite is determined in each location, and the average value of the area ratios of the ten locations is used as the proportion of non-recrystallized ferrite in the metallic structure.

Sheet Thickness: 0.4 mm or Less

Sheet metal thinning of steel sheets is being promoted for the purpose of reducing costs of can production. However, the sheet metal thinning of steel sheets, that is, the reduction of steel sheet thickness may lead to a decrease in can body strength and shaping defects during forming. With this respect, the steel sheet for cans of the present embodiment neither decreases the can body strength such as the pressure resistance of a can lid, nor causes forming defects such as dents during forming, even if the sheet thickness is small. In other words, the effects of the present disclosure of high strength and high forming accuracy are remarkably exhibited in a case of a small sheet thickness. Therefore, the sheet thickness of the steel sheet for cans is preferably 0.4 mm or less from this viewpoint. The sheet thickness may be 0.3 mm or less or 0.2 mm or less.

Next, a method of producing a steel sheet for cans according to one embodiment of the present disclosure will be described. Hereinafter, the temperature is based on the surface temperature of the steel sheet. The average cooling rate is a value obtained by calculation based on the surface temperature of the steel sheet as follows. For example, the average cooling rate from 500° C. to 300° C. is expressed by {(500° C.)−(300° C.)}/(cooling time from 500° C. to 300° C.).

During the production of a steel sheet for cans according to the present embodiment, molten steel is adjusted to have the chemical composition described above with a known method using a converter or the like, and then the steel is, for example, subjected to continuous casting to obtain a slab.

Slab Heating Temperature: 1200° C. or Higher

When the slab heating temperature in a hot rolling process is lower than 1200° C., non-recrystallized microstructure remains in the steel sheet after annealing, and dents occur when the steel sheet is formed into a neck portion of a can body. Therefore, the lower limit of the slab heating temperature is set to 1200° C. The slab heating temperature is preferably 1220° C. or higher. The upper limit of the slab heating temperature is preferably 1350° C. because the effect is saturated even if the temperature exceeds 1350° C.

Rolling Finish Temperature: 850° C. or Higher

When the finish temperature of a hot rolling process is lower than 850° C., non-recrystallized microstructure caused by the non-recrystallized microstructure of the hot-rolled steel sheet remains in the steel sheet after annealing, and dents occur due to local deformation during forming of the steel sheet. Therefore, the lower limit of the rolling finish temperature is set at 850° C. On the other hand, the rolling finish temperature is preferably 950° C. or lower, because in this case, scale formation on the surface of the steel sheet is suppressed, and better surface characteristics can be obtained.

Coiling Temperature: 640° C. or Higher and 780° C. or Lower

When the coiling temperature in a hot rolling process is lower than 640° C., a large amount of cementite precipitates in the hot-rolled steel sheet. As a result, the proportion of non-recrystallized ferrite in the metallic structure after annealing exceeds 3%, and dents occur due to local deformation when the steel sheet is formed into a neck portion of a can body. Therefore, the lower limit of the coiling temperature is set to 640° C. On the other hand, when the coiling temperature is higher than 780° C., a part of ferrite of the steel sheet after continuous annealing is coarsened, the steel sheet is softened, and the upper yield stress is less than 550 MPa. Therefore, the upper limit of the coiling temperature is set to 780° C. The coiling temperature is preferably 660° C. or higher. The coiling temperature is preferably 760° C. or lower. The coiling temperature is more preferably 660° C. or higher and 760° C. or lower.

Average Cooling Rate from 500° C. to 300° C.: 25° C./h or Higher and 55° C./h or Lower When the average cooling rate from 500° C. to 300° C. after coiling is lower than 25° C./h, a large amount of cementite precipitates in the hot-rolled steel sheet. As a result, the proportion of non-recrystallized ferrite in the metallic structure after annealing exceeds 3%, and dents occur due to local deformation when the steel sheet is formed into a neck portion of a can body. In addition, the amount of fine Ti-based carbides that contribute to strength is reduced, and the strength of the steel sheet is decreased. Therefore, the lower limit of the average cooling rate from 500° C. to 300° C. after coiling is set to 25° C./h. On the other hand, when the average cooling rate from 500° C. to 300° C. after coiling is higher than 55° C./h, the amount of solute C in the steel increases, and dents occur due to the solute C when the steel sheet is formed into a neck portion of a can body. Therefore, the upper limit of the average cooling rate from 500° C. to 300° C. after coiling is set to 55° C./h. The average cooling rate from 500° C. to 300° C. after coiling is preferably 30° C./h or higher. The average cooling rate from 500° C. to 300° C. after coiling is preferably 50° C./h or lower. The average cooling rate from 500° C. to 300° C. after coiling is more preferably 30° C./h or higher and 50° C./h or lower. The above average cooling rate can be achieved by air cooling. Note that the "average cooling rate" is based on the average temperature between the edge and the center in the coil width direction.

Acid Cleaning

Subsequently, it is preferable to perform acid cleaning if necessary. The conditions of acid cleaning are not limited as long as surface scales can be removed. Methods other than acid cleaning may also be used to remove scales.

Rolling Reduction in Cold Rolling: 86% or More

When the rolling reduction in a cold rolling process is less than 86%, the strain applied to the steel sheet by cold rolling is reduced, making it difficult to obtain an upper yield stress of 550 MPa or more for the steel sheet after annealing. Therefore, the rolling reduction in a cold rolling process is set to 86% or more. The rolling reduction in a cold rolling process is preferably 87% or more. The rolling reduction in a cold rolling process is preferably 94% or less. The rolling reduction in a cold rolling process is more preferably 87% or more and 94% or less. Other processes, such as an annealing process to soften the hot-rolled sheet, may be included as appropriate after the hot rolling process and before the cold rolling process. The cold rolling process may be performed immediately after the hot rolling process without acid cleaning.

Holding Temperature: 640° C. or Higher and 780° C. or Lower

When the holding temperature in an annealing process is higher than 780° C., sheet passing problems such as heat buckling are likely to occur during annealing. In addition, ferrite grains of the steel sheet are partially coarsened, the steel sheet is softened, and the upper yield stress is less than 550 MPa. Therefore, the holding temperature is set to 780° C. or lower. On the other hand, when the annealing temperature is lower than 640° C., recrystallization of ferrite grains is incomplete, the proportion of non-recrystallized ferrite exceeds 3%, and dents occur when the steel sheet is formed into a neck portion of a can body. Therefore, the holding temperature is set to 640° C. or higher. The holding temperature is preferably 660° C. or higher. The holding temperature is preferably 740° C. or lower. The holding temperature is more preferably 660° C. or higher and 740° C. or lower.

Holding Time in Temperature Range of 640° C. or Higher and 780° C. or Lower: 10 Seconds or Longer but 90 Seconds or Shorter When the holding time is longer than 90 seconds, Ti-based carbides precipitated mainly in a coiling process during hot rolling are coarsened as the temperature rises, resulting in a decrease in strength. On the other hand, when the holding time is shorter than 10 seconds, recrystallization of ferrite grains is incomplete, non-recrystallized grains remain, the proportion of non-recrystallized ferrite exceeds 3%, and dents occur when the steel sheet is formed into a neck portion of a can body.

A continuous annealing device may be used for annealing. Other processes, such as an annealing process to soften the hot-rolled sheet, may be included as appropriate after the cold rolling process and before the annealing process, or the annealing process may be performed immediately after the cold rolling process.

Primary Cooling: Cooling at Average Cooling Rate of 7° C./s or Higher and 180° C./s or Lower to Temperature Range of 500° C. or Higher and 600° C. or Lower After the holding, the steel sheet is cooled to a temperature range of 500° C. or higher and 600° C. or lower at an average cooling rate of 7° C./s or higher and 180° C./s or lower. When the average cooling rate is higher than 180° C./s, the steel sheet is excessively hardened, and dents occur when the steel sheet is formed into a neck portion of a can body. On the other hand, when the average cooling rate is lower than 7° C./s, Ti-based carbides are coarsened, and the strength decreases. The average cooling rate is preferably 20° C./s or higher. The average cooling rate is preferably 160° C./s or lower. The average cooling rate is more preferably 20° C./s or higher and 160° C./s or lower. When the cooling stop temperature in the primary cooling after holding is lower than 500° C., the steel sheet is excessively hardened, and dents occur when the steel sheet is formed into a neck portion of a can body. Therefore, the cooling stop temperature is set to 500° C. or higher. The cooling stop temperature in the primary cooling after holding is preferably 520° C. or higher. When the cooling stop temperature in the primary cooling after holding is higher than 600° C., Ti-based carbides are coarsened, and the strength decreases. Therefore, the cooling stop temperature is set to 600° C. or lower.

Secondary Cooling: Cooling at an Average Cooling Rate of 0.1° C./s or Higher and 10° C./s or Lower to 300° C. or Lower In secondary cooling after the primary cooling, the steel sheet is cooled to a temperature range of 300° C. or lower at an average cooling rate of 0.1° C./s or higher and 10° C./s or lower. When the average cooling rate is higher than 10° C./s, the steel sheet is excessively hardened, and dents occur when the steel sheet is formed into a neck portion of a can body. On the other hand, when the average cooling rate is lower than 0.1° C./s, Ti-based carbides are coarsened, and the strength decreases. The average cooling rate is preferably 1.0° C./s or higher. The average cooling rate is preferably 8.0° C./s or lower. The average cooling rate is more preferably 1.0° C./s or higher and 8.0° C./s or lower. In the secondary cooling, the steel sheet is cooled to 300° C. or lower. When the secondary cooling is stopped at a temperature higher than 300° C., the steel sheet is excessively hardened, and dents occur when the steel sheet is formed into a neck portion of a can body. It is preferable to perform the secondary cooling to 290° C. or lower.

Rolling Reduction in Temper Rolling: 0.1% or More and 3.0% or Less

When the rolling reduction in temper rolling after the annealing is more than 3.0%, too much strain hardening is introduced into the steel sheet. As a result, the strength of the steel sheet may be excessively increased, and dents may occur during forming of the steel sheet, for example, when forming the steel sheet into a neck portion of a can body. Therefore, the rolling reduction in temper rolling is set to 3.0% or less and is preferably 1.6% or less. On the other hand, the temper rolling plays a role of imparting surface roughness to the steel sheet. To impart uniform surface roughness to the steel sheet and to obtain an upper yield stress of 550 MPa or more, it is necessary to set the rolling reduction of temper rolling to 0.1% or more. The temper rolling process may be performed in the annealing device or may be performed as an independent rolling process.

The steel sheet for cans of the present embodiment can be obtained as described above. In the present disclosure, various processes may further be performed after the temper rolling. For example, the steel sheet for cans of the present disclosure may have a coating or plating layer on the steel sheet surface. Examples of the coating or plating layer include a Sn coating or plating layer, a Cr coating or plating layer such as a tin-free one, a Ni coating or plating layer, and a Sn—Ni coating or plating layer. In addition, paint baking treatment, film lamination, and other processes may also be performed. Because the thickness of the coating or plating, the laminated film or the like is very small compared with the sheet thickness, the effects of these on the mechanical properties of the steel sheet for cans can be ignored.

Examples

Steels having the chemical compositions listed in Table 1, each with the balance consisting of Fe and inevitable impurities, were prepared by steelmaking in a converter and subjected to continuous casting to obtain steel slabs. Next, the steel slabs were subjected to hot rolling under the hot rolling conditions listed in Tables 2 and 3 and to acid cleaning after the hot rolling. Next, cold rolling was performed with the rolling reduction listed in Tables 2 and 3, continuous annealing was performed under the annealing conditions listed in Tables 2 and 3, and subsequently temper rolling was performed with the rolling reduction listed in Tables 2 and 3 to obtain steel sheets. The steel sheets were continuously subjected to ordinary Sn coating or plating to obtain Sn-coated or Sn-plated steel sheets (tin plates) with a coating weight of 11.2 g/m$^2$ per surface. Next, the Sn-coated or Sn-plated steel sheets were subjected to heat treatment equivalent to paint baking treatment at 210° C. for 10 minutes and then subjected to the following evaluations.

<Tensile Test>

A tensile test was performed in accordance with a metal material tensile test method specified in "JIS Z 2241:2011". That is, a JIS No. 5 tensile test piece (JIS Z 2201) was collected so that the tensile direction was perpendicular to the rolling direction, a 50 mm (L) mark was added to the parallel portion of the tensile test piece, a tensile test in accordance with the provisions of JIS Z 2241 was performed at a tensile speed of 10 mm/min until the tensile test piece broke, and the upper yield stress was measured. The measurement results are listed in Table 2 and Table 3.

<Investigation of Metallic Structure>

A cross section of each Sn-coated or Sn-plated steel sheet in the thickness direction parallel to the rolling direction was polished and then etched with an etching solution (3 vol % nital). Next, an optical microscopy was used to observe an area from a position at a depth of ¼ sheet thickness (a position of ¼ sheet thickness in the thickness direction from the surface in the cross section) to a position of ½ sheet thickness in ten locations at 400 times magnification. Next, non-recrystallized ferrite in the metallic structure was identified visually using micrographs taken by the optical microscopy, and the area ratio of non-recrystallized ferrite was determined by image interpretation. As used herein, the non-recrystallized ferrite was a metallic structure that was elongated in the rolling direction under an optical microscopy at 400 times magnification. Next, the area ratio of non-recrystallized ferrite was determined in each location, and the average value of the area ratios of the ten locations was used as the proportion of non-recrystallized ferrite in the metallic structure. Image interpretation software (Particle Analysis made by NIPPON STEEL TECHNOLOGY Co., Ltd.) was used for the image interpretation. The investigation results are listed in Table 2 and Table 3.

<Corrosion Resistance>

For each Sn-coated or Sn-plated steel sheet, an area with a measurement area of 2.7 $mm^2$ was observed using an optical microscopy at 50 times magnification, and the number of hole-shaped positions where the Sn coating or plating was thin was measured. When the number of hole-shaped positions was less than 20, it was evaluated as good; when the number of hole-shaped positions was 20 or more and 25 or less, it was evaluated as fair; and when the number of hole-shaped positions was more than 25, it was evaluated as poor. The observation results are listed in Table 2 and Table 3.

<Occurrence of Dent>

A square blank was collected from each steel sheet and successively subjected to rolling, wire seam welding and neck forming to prepare a can body. The neck portion of the prepared can body was visually observed at eight locations in the circumferential direction to check for occurrence of dent. The evaluation results are listed in Table 2 and Table 3. When a dent occurred in any of the eight locations in the circumferential direction, it was evaluated as "occurrence of dent: yes"; and when no dent occurred in any of the eight locations in the circumferential direction, it was evaluated as "occurrence of dent: no".

TABLE 1

(mass %)

| Steel sample No. | C | Si | Mn | P | S | Al | N | Ti | Cr | B | Nb | Mo | V | Remarks |
|---|---|---|---|---|---|---|---|---|---|---|---|---|---|---|
| 1 | 0.029 | 0.01 | 0.53 | 0.009 | 0.0047 | 0.031 | 0.0042 | 0.064 | 0.021 | 0.0014 | tr. | tr. | tr. | Example |
| 2 | 0.036 | 0.03 | 0.44 | 0.008 | 0.0052 | 0.049 | 0.0045 | 0.058 | 0.025 | 0.0013 | tr. | tr. | tr. | Example |
| 3 | 0.049 | 0.01 | 0.39 | 0.010 | 0.0055 | 0.037 | 0.0041 | 0.062 | 0.027 | 0.0013 | tr. | tr. | tr. | Example |
| 4 | 0.016 | 0.01 | 0.43 | 0.010 | 0.0049 | 0.039 | 0.0039 | 0.051 | 0.019 | 0.0011 | tr. | tr. | tr. | Example |
| 5 | 0.112 | 0.01 | 0.41 | 0.008 | 0.0063 | 0.052 | 0.0043 | 0.067 | 0.024 | 0.0012 | tr. | tr. | tr. | Example |
| 6 | 0.038 | 0.01 | 0.14 | 0.008 | 0.0054 | 0.046 | 0.0043 | 0.025 | 0.036 | 0.0013 | tr. | tr. | tr. | Example |
| 7 | 0.024 | 0.01 | 0.86 | 0.007 | 0.0051 | 0.049 | 0.0038 | 0.044 | 0.023 | 0.0015 | tr. | tr. | tr. | Example |
| 8 | 0.037 | 0.02 | 0.57 | 0.009 | 0.0056 | 0.054 | 0.0046 | 0.058 | 0.028 | 0.0014 | tr. | tr. | tr. | Example |
| 9 | 0.041 | 0.01 | 0.20 | 0.008 | 0.0062 | 0.036 | 0.0040 | 0.036 | 0.032 | 0.0012 | tr. | tr. | tr. | Example |
| 10 | 0.035 | 0.02 | 0.42 | 0.008 | 0.0057 | 0.048 | 0.0042 | 0.053 | 0.005 | 0.0016 | tr. | tr. | tr. | Example |
| 11 | 0.044 | 0.01 | 0.51 | 0.009 | 0.0035 | 0.051 | 0.0044 | 0.047 | 0.026 | 0.0015 | tr. | tr. | tr. | Example |
| 12 | 0.028 | 0.02 | 0.45 | 0.010 | 0.0053 | 0.037 | 0.0041 | 0.055 | 0.066 | 0.0014 | tr. | tr. | tr. | Example |
| 13 | 0.013 | 0.01 | 0.53 | 0.010 | 0.0068 | 0.044 | 0.0039 | 0.029 | 0.025 | 0.0015 | tr. | tr. | tr. | Example |
| 14 | 0.046 | 0.02 | 0.48 | 0.009 | 0.0084 | 0.050 | 0.0046 | 0.049 | 0.034 | 0.0012 | tr. | tr. | tr. | Example |
| 15 | 0.038 | 0.01 | 0.42 | 0.008 | 0.0077 | 0.047 | 0.0043 | 0.013 | 0.027 | 0.0009 | tr. | tr. | tr. | Example |
| 16 | 0.042 | 0.01 | 0.46 | 0.010 | 0.0062 | 0.060 | 0.0035 | 0.038 | 0.020 | 0.0011 | tr. | tr. | tr. | Example |
| 17 | 0.045 | 0.02 | 0.53 | 0.011 | 0.0055 | 0.053 | 0.0049 | 0.030 | 0.026 | 0.0017 | tr. | tr. | tr. | Example |
| 18 | 0.039 | 0.01 | 0.35 | 0.010 | 0.0028 | 0.046 | 0.0042 | 0.046 | 0.031 | 0.0016 | tr. | tr. | tr. | Example |
| 19 | 0.027 | 0.01 | 0.52 | 0.009 | 0.0066 | 0.054 | 0.0019 | 0.044 | 0.029 | 0.0008 | tr. | tr. | tr. | Example |
| 20 | 0.034 | 0.02 | 0.43 | 0.011 | 0.0059 | 0.042 | 0.0023 | 0.053 | 0.032 | 0.0010 | tr. | tr. | tr. | Example |
| 21 | 0.029 | 0.01 | 0.47 | 0.008 | 0.0064 | 0.051 | 0.0047 | 0.026 | 0.018 | 0.0016 | tr. | tr. | tr. | Example |
| 22 | 0.043 | 0.01 | 0.50 | 0.010 | 0.0058 | 0.038 | 0.0042 | 0.011 | 0.025 | 0.0007 | tr. | tr. | tr. | Example |
| 23 | 0.036 | 0.01 | 0.49 | 0.012 | 0.0072 | 0.057 | 0.0045 | 0.079 | 0.024 | 0.0016 | tr. | tr. | tr. | Example |
| 24 | 0.048 | 0.02 | 0.51 | 0.009 | 0.0056 | 0.039 | 0.0043 | 0.052 | 0.031 | 0.0019 | tr. | tr. | tr. | Example |
| 25 | 0.044 | 0.01 | 0.48 | 0.009 | 0.0061 | 0.043 | 0.0038 | 0.035 | 0.033 | 0.0005 | tr. | tr. | tr. | Example |
| 26 | 0.037 | 0.01 | 0.46 | 0.011 | 0.0070 | 0.052 | 0.0043 | 0.047 | 0.029 | 0.0015 | tr. | tr. | 0.034 | Example |
| 27 | 0.042 | 0.02 | 0.44 | 0.008 | 0.0053 | 0.051 | 0.0041 | 0.051 | 0.037 | 0.0017 | tr. | 0.028 | tr. | Example |
| 28 | 0.026 | 0.01 | 0.52 | 0.009 | 0.0065 | 0.046 | 0.0041 | 0.036 | 0.025 | 0.0014 | 0.036 | tr. | tr. | Example |
| 29 | 0.055 | 0.02 | 0.37 | 0.010 | 0.0048 | 0.053 | 0.0039 | 0.043 | 0.032 | 0.0016 | 0.024 | 0.027 | tr. | Example |
| 30 | 0.038 | 0.01 | 0.45 | 0.010 | 0.0056 | 0.038 | 0.0042 | 0.027 | 0.031 | 0.0013 | 0.021 | tr. | 0.032 | Example |
| 31 | 0.194 | 0.01 | 0.51 | 0.011 | 0.0062 | 0.044 | 0.0045 | 0.064 | 0.024 | 0.0015 | tr. | tr. | tr. | Comparative Example |
| 32 | 0.136 | 0.02 | 0.48 | 0.008 | 0.0054 | 0.038 | 0.0041 | 0.052 | 0.033 | 0.0016 | tr. | tr. | tr. | Comparative Example |
| 33 | 0.038 | 0.01 | 0.53 | 0.010 | 0.0175 | 0.053 | 0.0043 | 0.060 | 0.028 | 0.0014 | tr. | tr. | tr. | Comparative Example |
| 34 | 0.024 | 0.01 | 0.47 | 0.011 | 0.0061 | 0.047 | 0.0041 | 0.055 | 0.124 | 0.0018 | tr. | tr. | tr. | Comparative Example |
| 35 | 0.005 | 0.02 | 0.39 | 0.009 | 0.0058 | 0.052 | 0.0042 | 0.021 | 0.036 | 0.0008 | tr. | tr. | tr. | Comparative Example |
| 36 | 0.008 | 0.01 | 0.45 | 0.010 | 0.0056 | 0.055 | 0.0046 | 0.019 | 0.027 | 0.0009 | tr. | tr. | tr. | Comparative Example |
| 37 | 0.042 | 0.09 | 0.54 | 0.011 | 0.0073 | 0.048 | 0.0045 | 0.042 | 0.038 | 0.0013 | tr. | tr. | tr. | Comparative Example |
| 38 | 0.029 | 0.02 | 1.73 | 0.010 | 0.0054 | 0.039 | 0.0043 | 0.053 | 0.021 | 0.0015 | tr. | tr. | tr. | Comparative Example |

TABLE 1-continued (mass %)

| Steel sample No. | C | Si | Mn | P | S | Al | N | Ti | Cr | B | Nb | Mo | V | Remarks |
|---|---|---|---|---|---|---|---|---|---|---|---|---|---|---|
| 39 | 0.057 | 0.01 | 0.02 | 0.011 | 0.0062 | 0.051 | 0.0046 | 0.038 | 0.046 | 0.0017 | tr. | tr. | tr. | Comparative Example |
| 40 | 0.036 | 0.01 | 0.37 | 0.154 | 0.0064 | 0.050 | 0.0045 | 0.050 | 0.033 | 0.0014 | tr. | tr. | tr. | Comparative Example |
| 41 | 0.053 | 0.02 | 0.42 | 0.009 | 0.0055 | 0.038 | 0.0232 | 0.064 | 0.029 | 0.0018 | tr. | tr. | tr. | Comparative Example |
| 42 | 0.048 | 0.02 | 0.39 | 0.009 | 0.0063 | 0.046 | 0.0184 | 0.057 | 0.017 | 0.0017 | tr. | tr. | tr. | Comparative Example |
| 43 | 0.069 | 0.02 | 0.46 | 0.011 | 0.0071 | 0.053 | 0.0044 | 0.193 | 0.035 | 0.0019 | tr. | tr. | tr. | Comparative Example |
| 44 | 0.056 | 0.01 | 0.50 | 0.010 | 0.0064 | 0.046 | 0.0037 | 0.151 | 0.028 | 0.0013 | tr. | tr. | tr. | Comparative Example |
| 45 | 0.017 | 0.01 | 0.45 | 0.012 | 0.0015 | 0.039 | 0.0046 | 0.003 | 0.042 | 0.0014 | tr. | tr. | tr. | Comparative Example |
| 46 | 0.044 | 0.02 | 0.53 | 0.009 | 0.0037 | 0.057 | 0.0044 | 0.048 | 0.037 | 0.0003 | tr. | tr. | tr. | Comparative Example |
| 47 | 0.039 | 0.01 | 0.54 | 0.010 | 0.0052 | 0.048 | 0.0044 | 0.026 | 0.024 | 0.0021 | tr. | tr. | tr. | Comparative Example |
| 48 | 0.053 | 0.01 | 0.37 | 0.008 | 0.0066 | 0.052 | 0.0046 | 0.061 | 0.031 | 0.0027 | 0.026 | tr. | tr. | Comparative Example |
| 49 | 0.048 | 0.02 | 0.44 | 0.011 | 0.0053 | 0.053 | 0.0039 | 0.053 | 0.028 | 0.0023 | tr. | 0.041 | tr. | Comparative Example |

Note that underline indicates it is outside the scope of the present disclosure.

TABLE 2

| | | Hot rolling process | | | | | | Annealing process | | | | | |
|---|---|---|---|---|---|---|---|---|---|---|---|---|---|
| Steel sheet sample No. | Steel sample No. | Slab heating temperature (° C.) | Rolling finish temperature (° C.) | Coiling temperature (° C.) | Cooling rate at 500° C. to 300° C. after coiling (° C./h) | Hot-rolled sheet thickness (mm) | Cold rolling process Rolling reduction (%) | Soaking temperature (° C.) | Soaking holding time (s) | Primary cooling rate (° C./s) | Primary cooling stop temperature (° C.) | Secondary cooling rate (° C./s) | Secondary cooling stop temperature (° C.) |
| 1 | 1 | 1225 | 905 | 685 | 43 | 2.5 | 92 | 725 | 29 | 53 | 540 | 3.7 | 275 |
| 2 | 2 | 1205 | 900 | 660 | 35 | 2.3 | 92 | 750 | 75 | 75 | 555 | 7.1 | 260 |
| 3 | 3 | 1220 | 895 | 690 | 37 | 2.5 | 91 | 710 | 33 | 68 | 515 | 4.5 | 265 |
| 4 | 4 | 1210 | 890 | 675 | 26 | 1.8 | 89 | 695 | 86 | 51 | 575 | 2.8 | 280 |
| 5 | 5 | 1215 | 870 | 705 | 39 | 2.3 | 92 | 730 | 41 | 124 | 505 | 4.3 | 270 |
| 6 | 6 | 1225 | 895 | 680 | 41 | 2.3 | 91 | 680 | 69 | 49 | 550 | 1.9 | 285 |
| 7 | 7 | 1240 | 915 | 720 | 53 | 1.9 | 91 | 705 | 34 | 27 | 595 | 8.7 | 250 |
| 8 | 8 | 1235 | 900 | 705 | 33 | 2.5 | 92 | 715 | 52 | 55 | 550 | 4.6 | 285 |
| 9 | 9 | 1210 | 860 | 695 | 46 | 2.5 | 90 | 720 | 28 | 92 | 575 | 5.2 | 260 |
| 10 | 10 | 1230 | 885 | 665 | 31 | 2.0 | 89 | 705 | 36 | 76 | 540 | 3.6 | 270 |
| 11 | 11 | 1205 | 875 | 690 | 35 | 2.3 | 89 | 710 | 44 | 66 | 560 | 7.3 | 255 |
| 12 | 12 | 1200 | 860 | 645 | 42 | 1.8 | 90 | 690 | 73 | 104 | 505 | 0.8 | 295 |
| 13 | 13 | 1215 | 870 | 680 | 29 | 1.8 | 91 | 665 | 19 | 139 | 505 | 1.6 | 275 |
| 14 | 14 | 1230 | 880 | 730 | 36 | 1.9 | 89 | 755 | 50 | 126 | 510 | 3.2 | 280 |
| 15 | 15 | 1240 | 905 | 695 | 33 | 1.7 | 87 | 685 | 47 | 80 | 535 | 3.8 | 265 |
| 16 | 16 | 1215 | 895 | 680 | 42 | 2.4 | 92 | 705 | 35 | 52 | 550 | 4.2 | 260 |
| 17 | 17 | 1235 | 915 | 675 | 51 | 3.2 | 94 | 730 | 77 | 118 | 530 | 1.1 | 290 |
| 18 | 18 | 1255 | 915 | 660 | 26 | 2.6 | 92 | 670 | 42 | 97 | 520 | 2.4 | 245 |
| 19 | 19 | 1265 | 920 | 710 | 53 | 2.5 | 90 | 680 | 23 | 63 | 560 | 4.6 | 250 |
| 20 | 20 | 1240 | 905 | 700 | 32 | 2.5 | 92 | 700 | 56 | 44 | 575 | 6.0 | 280 |
| 21 | 21 | 1250 | 935 | 690 | 44 | 2.5 | 90 | 725 | 30 | 71 | 545 | 5.7 | 275 |
| 22 | 22 | 1280 | 940 | 705 | 27 | 2.6 | 90 | 695 | 39 | 65 | 560 | 6.4 | 280 |
| 23 | 23 | 1230 | 895 | 690 | 45 | 2.3 | 90 | 740 | 71 | 39 | 590 | 9.6 | 260 |
| 24 | 24 | 1220 | 890 | 665 | 38 | 2.4 | 89 | 715 | 48 | 102 | 535 | 5.0 | 290 |
| 25 | 25 | 1220 | 880 | 660 | 35 | 2.0 | 91 | 675 | 34 | 87 | 550 | 4.3 | 270 |
| 26 | 26 | 1205 | 855 | 685 | 43 | 2.0 | 91 | 705 | 52 | 54 | 535 | 3.9 | 275 |
| 27 | 27 | 1215 | 885 | 705 | 28 | 2.4 | 91 | 730 | 37 | 122 | 540 | 3.5 | 285 |
| 28 | 28 | 1230 | 890 | 690 | 40 | 2.4 | 92 | 710 | 46 | 48 | 550 | 7.8 | 255 |
| 29 | 29 | 1225 | 900 | 680 | 33 | 2.0 | 90 | 725 | 75 | 90 | 550 | 4.4 | 275 |
| 30 | 30 | 1220 | 885 | 670 | 36 | 2.6 | 91 | 715 | 53 | 67 | 530 | 5.2 | 280 |
| 31 | 31 | 1235 | 900 | 705 | 41 | 2.5 | 90 | 740 | 35 | 42 | 555 | 4.7 | 270 |
| 32 | 32 | 1210 | 885 | 665 | 37 | 2.2 | 91 | 725 | 71 | 28 | 580 | 5.3 | 265 |
| 33 | 33 | 1240 | 860 | 690 | 52 | 2.4 | 91 | 690 | 43 | 56 | 560 | 3.6 | 275 |
| 34 | 34 | 1225 | 905 | 710 | 38 | 2.3 | 93 | 715 | 55 | 74 | 535 | 2.8 | 270 |

TABLE 2-continued

| | | | | | | | | | | | | | |
|---|---|---|---|---|---|---|---|---|---|---|---|---|---|
| 35 | 35 | 1230 | 880 | 685 | 29 | 2.0 | 92 | 670 | 30 | 128 | 515 | 1.9 | 280 |
| 36 | 36 | 1210 | 895 | 705 | 40 | 1.8 | 90 | 660 | 68 | 87 | 570 | 7.2 | 255 |
| 37 | 37 | 1235 | 905 | 645 | 51 | 1.8 | 88 | 700 | 29 | 103 | 560 | 4.5 | 265 |
| 38 | 38 | 1215 | 900 | 660 | 39 | 2.2 | 92 | 730 | 63 | 26 | 595 | 1.3 | 295 |
| 39 | 39 | 1205 | 875 | 695 | 43 | 2.5 | 92 | 695 | 37 | 141 | 505 | 8.7 | 255 |
| 40 | 40 | 1210 | 855 | 710 | 44 | 1.9 | 90 | 720 | 42 | 75 | 520 | 6.4 | 270 |
| 41 | 41 | 1250 | 870 | 680 | 35 | 2.6 | 91 | 710 | 56 | 92 | 515 | 7.7 | 260 |
| 42 | 42 | 1270 | 930 | 695 | 37 | 3.2 | 94 | 690 | 38 | 68 | 530 | 5.8 | 265 |
| 43 | 43 | 1225 | 880 | 705 | 52 | 2.4 | 90 | 715 | 44 | 54 | 545 | 3.0 | 280 |
| 44 | 44 | 1230 | 910 | 670 | 28 | 2.3 | 91 | 685 | 62 | 77 | 540 | 4.9 | 285 |
| 45 | 45 | 1215 | 890 | 685 | 46 | 2.3 | 92 | 670 | 37 | 115 | 585 | 3.6 | 280 |
| 46 | 46 | 1240 | 905 | 700 | 39 | 2.3 | 90 | 690 | 54 | 90 | 560 | 4.4 | 280 |
| 47 | 47 | 1220 | 910 | 725 | 42 | 2.5 | 91 | 720 | 48 | 49 | 545 | 3.7 | 270 |
| 48 | 48 | 1235 | 890 | 665 | 35 | 2.5 | 90 | 710 | 32 | 83 | 520 | 2.9 | 275 |
| 49 | 49 | 1215 | 890 | 680 | 50 | 2.1 | 91 | 715 | 66 | 61 | 535 | 3.1 | 270 |

| | Temper rolling process | | | Proportion of | Upper yield | Evaluation | | |
|---|---|---|---|---|---|---|---|---|
| Steel sheet sample No. | Rolling reduction (%) | Final sheet thickness (mm) | (Ti*/48)/(C/12) | non-recrystallized ferrite (%) | stress in rolling direction (MPa) | Corrosion resistance | Dent in neck portion | Remarks |
| 1 | 1.2 | 0.20 | 0.491 | 2.5 | 591 | Good | No | Example |
| 2 | 1.6 | 0.18 | 0.349 | 2.8 | 559 | Good | No | Example |
| 3 | 0.9 | 0.22 | 0.274 | 1.4 | 594 | Good | No | Example |
| 4 | 1.4 | 0.20 | 0.682 | 2.2 | 577 | Good | No | Example |
| 5 | 1.0 | 0.18 | 0.128 | 2.7 | 617 | Good | No | Example |
| 6 | 1.5 | 0.20 | 0.111 | 1.6 | 561 | Good | No | Example |
| 7 | 2.3 | 0.17 | 0.379 | 2.6 | 606 | Good | No | Example |
| 8 | 1.9 | 0.20 | 0.335 | 2.5 | 602 | Good | No | Example |
| 9 | 1.1 | 0.25 | 0.163 | 1.7 | 565 | Good | No | Example |
| 10 | 1.7 | 0.22 | 0.318 | 2.4 | 559 | Good | No | Example |
| 11 | 2.6 | 0.25 | 0.237 | 2.6 | 573 | Good | No | Example |
| 12 | 0.5 | 0.18 | 0.420 | 2.7 | 605 | Good | No | Example |
| 13 | 0.3 | 0.16 | 0.362 | 0.8 | 556 | Good | No | Example |
| 14 | 2.1 | 0.20 | 0.198 | 1.2 | 564 | Good | No | Example |
| 15 | 0.4 | 0.22 | 0.010 | 2.5 | 592 | Good | No | Example |
| 16 | 2.0 | 0.19 | 0.171 | 2.5 | 603 | Good | No | Example |
| 17 | 2.8 | 0.19 | 0.121 | 2.7 | 613 | Good | No | Example |
| 18 | 1.3 | 0.21 | 0.268 | 2.4 | 561 | Good | No | Example |
| 19 | 2.2 | 0.24 | 0.316 | 1.3 | 576 | Good | No | Example |
| 20 | 1.1 | 0.20 | 0.325 | 1.8 | 595 | Good | No | Example |
| 21 | 0.8 | 0.25 | 0.141 | 2.3 | 604 | Good | No | Example |
| 22 | 1.5 | 0.26 | 0.013 | 0.7 | 587 | Good | No | Example |
| 23 | 2.4 | 0.22 | 0.474 | 1.1 | 612 | Good | No | Example |
| 24 | 1.8 | 0.26 | 0.227 | 2.5 | 606 | Good | No | Example |
| 25 | 0.7 | 0.18 | 0.147 | 1.6 | 563 | Good | No | Example |
| 26 | 0.9 | 0.18 | 0.247 | 2.3 | 579 | Good | No | Example |
| 27 | 2.2 | 0.21 | 0.256 | 2.5 | 590 | Good | No | Example |
| 28 | 1.8 | 0.19 | 0.252 | 2.1 | 594 | Good | No | Example |
| 29 | 2.1 | 0.20 | 0.163 | 2.6 | 614 | Good | No | Example |
| 30 | 1.4 | 0.23 | 0.122 | 2.5 | 603 | Good | No | Example |
| 31 | 2.2 | 0.24 | 0.070 | 11.7 | 664 | Good | Yes | Comparative Example |
| 32 | 1.7 | 0.19 | 0.081 | 9.4 | 650 | Good | Yes | Comparative Example |
| 33 | 1.2 | 0.21 | 0.222 | 2.8 | 516 | Good | No | Comparative Example |
| 34 | 2.5 | 0.16 | 0.478 | 2.9 | 523 | Good | No | Comparative Example |
| 35 | 1.6 | 0.16 | 0.615 | 1.2 | 494 | Good | No | Comparative Example |
| 36 | 0.9 | 0.18 | 0.925 | 0.8 | 468 | Good | Yes | Comparative Example |
| 37 | 1.3 | 0.21 | 0.185 | 2.7 | 569 | Poor | No | Comparative Example |
| 38 | 1.5 | 0.17 | 0.387 | 13.3 | 581 | Good | Yes | Comparative Example |
| 39 | 2.7 | 0.19 | 0.126 | 2.8 | 497 | Good | No | Comparative Example |
| 40 | 2.4 | 0.19 | 0.281 | 2.9 | 662 | Poor | Yes | Comparative Example |
| 41 | 1.8 | 0.23 | 0.263 | 2.8 | 515 | Good | No | Comparative Example |
| 42 | 1.1 | 0.19 | 0.248 | 2.8 | 529 | Good | No | Comparative Example |

TABLE 2-continued

| | | | | | | | | |
|---|---|---|---|---|---|---|---|---|
| 43 | 1.5 | 0.24 | 0.844 | 6.0 | 594 | Good | Yes | Comparative Example |
| 44 | 2.0 | 0.20 | 0.631 | 6.0 | 587 | Good | Yes | Comparative Example |
| 45 | 0.8 | 0.18 | 0.003 | 12.0 | 496 | Good | Yes | Comparative Example |
| 46 | 1.2 | 0.23 | 0.241 | 2.7 | 483 | Good | No | Comparative Example |
| 47 | 0.5 | 0.22 | 0.117 | 6.2 | 556 | Good | Yes | Comparative Example |
| 48 | 1.4 | 0.25 | 0.241 | 7.4 | 595 | Good | Yes | Comparative Example |
| 49 | 2.3 | 0.18 | 0.235 | 9.5 | 602 | Good | Yes | Comparative Example |

Note that underline indicates it is outside the scope of the present disclosure.

TABLE 3

| | | Hot rolling process | | | | | | Annealing process | | | | | |
|---|---|---|---|---|---|---|---|---|---|---|---|---|---|
| Steel sheet sample No. | Steel sample No. | Slab heating temperature (° C.) | Rolling finish temperature (° C.) | Coiling temperature (° C.) | Cooling rate at 500° C. to 300° C. after coiling (° C./h) | Hot-rolled sheet thickness (mm) | Cold rolling process Rolling reduction (%) | Soaking temperature (° C.) | Soaking holding time (s) | Primary cooling rate (° C./s) | Primary cooling stop temperature (° C.) | Secondary cooling rate (° C./s) | Secondary cooling stop temperature (° C.) |
| 50 | 3 | 1240 | 890 | 710 | 31 | 2.0 | 89 | 680 | 79 | 34 | 575 | 8.9 | 255 |
| 51 | 3 | 1080 | 910 | 685 | 45 | 2.0 | 92 | 725 | 31 | 90 | 540 | 2.3 | 285 |
| 52 | 3 | 1215 | 790 | 650 | 42 | 2.3 | 92 | 760 | 45 | 135 | 520 | 2.1 | 270 |
| 53 | 3 | 1230 | 930 | 800 | 37 | 2.0 | 90 | 710 | 63 | 117 | 520 | 1.5 | 290 |
| 54 | 3 | 1220 | 895 | 680 | 37 | 2.0 | 90 | 690 | 50 | 52 | 550 | 7.0 | 260 |
| 55 | 3 | 1205 | 905 | 705 | 52 | 1.7 | 84 | 705 | 28 | 73 | 540 | 1.9 | 270 |
| 56 | 9 | 1225 | 890 | 650 | 41 | 2.5 | 90 | 600 | 42 | 28 | 585 | 7.6 | 260 |
| 57 | 9 | 1210 | 885 | 690 | 35 | 1.8 | 89 | 680 | 76 | 46 | 545 | 5.3 | 275 |
| 58 | 9 | 1235 | 910 | 665 | 35 | 1.8 | 91 | 690 | 35 | 51 | 555 | 3.9 | 280 |
| 59 | 9 | 1220 | 905 | 670 | 35 | 2.4 | 91 | 825 | 19 | 147 | 505 | 0.4 | 285 |
| 60 | 9 | 1220 | 900 | 660 | 28 | 2.2 | 88 | 695 | 114 | 25 | 590 | 7.8 | 250 |
| 61 | 9 | 1230 | 915 | 680 | 36 | 2.4 | 90 | 660 | 7 | 49 | 560 | 5.5 | 265 |
| 62 | 9 | 1200 | 900 | 690 | 52 | 2.0 | 88 | 650 | 53 | 5 | 585 | 1.2 | 290 |
| 63 | 9 | 1250 | 930 | 710 | 44 | 2.0 | 92 | 675 | 37 | 214 | 515 | 1.7 | 270 |
| 64 | 9 | 1225 | 910 | 700 | 29 | 2.0 | 90 | 730 | 44 | 60 | 540 | 4.3 | 245 |
| 65 | 15 | 1220 | 905 | 670 | 32 | 1.7 | 90 | 715 | 40 | 83 | 445 | 5.6 | 275 |
| 66 | 15 | 1210 | 890 | 715 | 37 | 1.7 | 90 | 700 | 29 | 15 | 660 | 4.1 | 280 |
| 67 | 15 | 1215 | 895 | 710 | 50 | 2.3 | 90 | 685 | 57 | 62 | 520 | 1.9 | 280 |
| 68 | 15 | 1230 | 905 | 680 | 38 | 2.3 | 89 | 710 | 36 | 107 | 510 | 0.04 | 290 |
| 69 | 15 | 1215 | 890 | 680 | 27 | 1.9 | 91 | 720 | 48 | 88 | 530 | 28.3 | 245 |
| 70 | 24 | 1240 | 920 | 715 | 14 | 1.9 | 91 | 730 | 26 | 94 | 525 | 3.0 | 280 |
| 71 | 24 | 1250 | 925 | 675 | 96 | 2.2 | 92 | 715 | 59 | 57 | 550 | 4.4 | 270 |
| 72 | 24 | 1205 | 865 | 490 | 48 | 2.2 | 92 | 700 | 61 | 44 | 570 | 8.6 | 265 |
| 73 | 24 | 1210 | 870 | 670 | 34 | 2.2 | 90 | 690 | 37 | 35 | 580 | 7.7 | 270 |
| 74 | 24 | 1230 | 890 | 695 | 51 | 2.5 | 90 | 705 | 45 | 67 | 545 | 3.8 | 405 |
| 75 | 24 | 1225 | 900 | 710 | 38 | 2.5 | 92 | 685 | 27 | 52 | 550 | 4.2 | 260 |
| 76 | 28 | 1240 | 910 | 670 | 52 | 3.2 | 92 | 695 | 73 | 70 | 535 | 5.5 | 255 |
| 77 | 28 | 1215 | 875 | 655 | 33 | 3.2 | 92 | 720 | 52 | 123 | 515 | 0.9 | 285 |
| 78 | 28 | 1230 | 915 | 715 | 46 | 2.4 | 91 | 710 | 60 | 76 | 525 | 3.6 | 270 |
| 79 | 28 | 1245 | 905 | 690 | 40 | 2.3 | 90 | 725 | 49 | 56 | 560 | 7.1 | 265 |
| 80 | 33 | 1220 | 865 | 680 | 27 | 2.0 | 92 | 705 | 56 | 61 | 545 | 0.03 | 295 |
| 81 | 33 | 1205 | 900 | 700 | 43 | 2.0 | 92 | 660 | 38 | 52 | 550 | 31.4 | 250 |
| 82 | 33 | 1230 | 885 | 690 | 31 | 1.8 | 90 | 735 | 31 | 4 | 590 | 8.2 | 260 |
| 83 | 33 | 1215 | 870 | 685 | 54 | 1.8 | 89 | 690 | 42 | 207 | 505 | 4.5 | 275 |
| 84 | 33 | 1250 | 910 | 720 | 33 | 2.5 | 91 | 705 | 37 | 93 | 440 | 2.7 | 285 |
| 85 | 33 | 1225 | 920 | 665 | 28 | 2.3 | 91 | 720 | 18 | 42 | 675 | 4.3 | 265 |
| 86 | 33 | 1210 | 870 | 705 | 35 | 2.3 | 91 | 680 | 84 | 59 | 555 | 6.0 | 255 |
| 87 | 37 | 1235 | 895 | 645 | 31 | 2.5 | 91 | 685 | 73 | 85 | 530 | 2.8 | 280 |
| 88 | 37 | 1240 | 860 | 680 | 46 | 1.9 | 88 | 715 | 40 | 106 | 515 | 3.1 | 415 |
| 89 | 37 | 1260 | 920 | 665 | 52 | 2.1 | 91 | 695 | 132 | 58 | 560 | 5.6 | 260 |
| 90 | 37 | 1200 | 905 | 710 | 29 | 2.1 | 90 | 720 | 6 | 74 | 545 | 0.8 | 290 |
| 91 | 37 | 1210 | 890 | 650 | 32 | 2.0 | 90 | 605 | 55 | 101 | 510 | 2.9 | 280 |
| 92 | 37 | 1225 | 870 | 660 | 36 | 2.0 | 89 | 830 | 29 | 129 | 510 | 5.4 | 265 |
| 93 | 47 | 1215 | 855 | 705 | 42 | 1.7 | 83 | 700 | 46 | 38 | 570 | 1.7 | 270 |
| 94 | 47 | 1245 | 925 | 690 | 7 | 3.2 | 93 | 670 | 78 | 27 | 590 | 2.0 | 270 |
| 95 | 47 | 1230 | 865 | 680 | 91 | 2.6 | 92 | 725 | 32 | 45 | 585 | 3.8 | 260 |
| 96 | 49 | 1240 | 880 | 485 | 44 | 2.4 | 90 | 740 | 51 | 63 | 535 | 4.4 | 275 |

TABLE 3-continued

| | | | | | | | | | | | | | |
|---|---|---|---|---|---|---|---|---|---|---|---|---|---|
| 97 | 49 | 1220 | 770 | 695 | 53 | 2.4 | 89 | 705 | 64 | 112 | 525 | 7.2 | 255 |
| 98 | 49 | 1065 | 905 | 705 | 33 | 2.3 | 89 | 730 | 56 | 54 | 540 | 6.5 | 265 |

| | Temper rolling process | | | Proportion of | Upper yield | Evaluation | | |
|---|---|---|---|---|---|---|---|---|
| Steel sheet sample No. | Rolling reduction (%) | Final sheet thickness (mm) | (Ti*/48)/(C/12) | non-recrystallized ferrite (%) | stress in rolling direction (MPa) | Corrosion resistance | Dent in neck portion | Remarks |
| 50 | 1.5 | 0.22 | 0.274 | 1.5 | 601 | Good | No | Example |
| 51 | 0.7 | 0.16 | 0.274 | 5.3 | 572 | Good | Yes | Comparative Example |
| 52 | 1.8 | 0.18 | 0.274 | 4.2 | 585 | Good | Yes | Comparative Example |
| 53 | 2.2 | 0.20 | 0.274 | 2.7 | 487 | Good | No | Comparative Example |
| 54 | 0.5 | 0.20 | 0.274 | 1.6 | 609 | Good | No | Example |
| 55 | 2.8 | 0.26 | 0.274 | 2.0 | 513 | Good | No | Comparative Example |
| 56 | 2.5 | 0.24 | 0.163 | 11.4 | 564 | Good | Yes | Comparative Example |
| 57 | 2.3 | 0.19 | 0.163 | 1.2 | 596 | Good | No | Example |
| 58 | 1.6 | 0.16 | 0.163 | 2.1 | 617 | Good | No | Example |
| 59 | 1.4 | 0.21 | 0.163 | 0.3 | 466 | Good | No | Comparative Example |
| 60 | 1.4 | 0.26 | 0.163 | 2.2 | 502 | Good | No | Comparative Example |
| 61 | 1.7 | 0.24 | 0.163 | 7.5 | 575 | Good | Yes | Comparative Example |
| 62 | 1.3 | 0.24 | 0.163 | 1.6 | 516 | Good | No | Comparative Example |
| 63 | 1.9 | 0.16 | 0.163 | 2.8 | 637 | Good | Yes | Comparative Example |
| 64 | 0.6 | 0.20 | 0.163 | 2.3 | 612 | Good | No | Example |
| 65 | 1.2 | 0.17 | 0.010 | 2.2 | 639 | Good | Yes | Comparative Example |
| 66 | 1.2 | 0.17 | 0.010 | 1.9 | 523 | Good | No | Comparative Example |
| 67 | 1.9 | 0.23 | 0.010 | 2.6 | 588 | Good | No | Example |
| 68 | 1.9 | 0.25 | 0.010 | 2.0 | 484 | Good | No | Comparative Example |
| 69 | 1.9 | 0.17 | 0.010 | 2.4 | 637 | Good | Yes | Comparative Example |
| 70 | 1.5 | 0.17 | 0.227 | 8.1 | 557 | Good | Yes | Comparative Example |
| 71 | 1.0 | 0.17 | 0.227 | 2.8 | 641 | Good | Yes | Comparative Example |
| 72 | 1.4 | 0.17 | 0.227 | 10.5 | 590 | Good | Yes | Comparative Example |
| 73 | 2.2 | 0.22 | 0.227 | 1.8 | 582 | Good | No | Example |
| 74 | 1.6 | 0.25 | 0.227 | 2.7 | 636 | Good | Yes | Comparative Example |
| 75 | 0.05 | 0.20 | 0.227 | 2.6 | 514 | Good | No | Comparative Example |
| 76 | 3.9 | 0.25 | 0.252 | 2.3 | 635 | Good | Yes | Comparative Example |
| 77 | 1.2 | 0.25 | 0.252 | 1.8 | 598 | Good | No | Example |
| 78 | 0.9 | 0.21 | 0.252 | 2.2 | 613 | Good | No | Example |
| 79 | 2.3 | 0.22 | 0.252 | 2.5 | 609 | Good | No | Example |
| 80 | 1.8 | 0.16 | 0.222 | 2.7 | 502 | Good | No | Comparative Example |
| 81 | 2.1 | 0.16 | 0.222 | 2.8 | 496 | Good | Yes | Comparative Example |
| 82 | 1.5 | 0.18 | 0.222 | 2.6 | 491 | Good | No | Comparative Example |
| 83 | 1.4 | 0.20 | 0.222 | 2.9 | 535 | Good | Yes | Comparative Example |
| 84 | 1.2 | 0.22 | 0.222 | 2.8 | 539 | Good | Yes | Comparative Example |
| 85 | 1.2 | 0.20 | 0.222 | 2.7 | 494 | Good | No | Comparative Example |
| 86 | 0.06 | 0.21 | 0.222 | 2.8 | 509 | Good | No | Comparative Example |
| 87 | 32.5 | 0.15 | 0.185 | 2.9 | 691 | Poor | Yes | Comparative Example |

TABLE 3-continued

| | | | | | | | | |
|---|---|---|---|---|---|---|---|---|
| 88 | 2.0 | 0.22 | 0.185 | 2.6 | 637 | Poor | Yes | Comparative Example |
| 89 | 1.9 | 0.19 | 0.185 | 2.3 | 532 | Poor | No | Comparative Example |
| 90 | 2.3 | 0.21 | 0.185 | 6.5 | 566 | Poor | Yes | Comparative Example |
| 91 | 1.7 | 0.20 | 0.185 | 13.2 | 558 | Poor | Yes | Comparative Example |
| 92 | 1.3 | 0.22 | 0.185 | 0.5 | 510 | Poor | No | Comparative Example |
| 93 | 1.6 | 0.28 | 0.117 | 9.5 | 527 | Good | Yes | Comparative Example |
| 94 | 1.4 | 0.22 | 0.117 | 10.7 | 554 | Good | Yes | Comparative Example |
| 95 | 0.7 | 0.21 | 0.117 | 8.3 | 579 | Good | Yes | Comparative Example |
| 96 | 0.9 | 0.24 | 0.235 | 7.9 | 576 | Good | Yes | Comparative Example |
| 97 | 1.8 | 0.26 | 0.235 | 8.7 | 562 | Good | Yes | Comparative Example |
| 98 | 1.5 | 0.25 | 0.235 | 8.4 | 580 | Good | Yes | Comparative Example |

Note that underline indicates it is outside the scope of the present disclosure.

INDUSTRIAL APPLICABILITY

According to the present disclosure, it is possible to obtain a steel sheet for cans with high strength and sufficiently high forming accuracy particularly as a material for a can body with a neck portion. Further, according to the present disclosure, the uniform deformability of the steel sheet is high, so that it is possible to produce a can body product with high forming accuracy during, for example, the forming of a can body. Furthermore, the steel sheet of the present disclosure is a most suitable steel sheet for cans, mainly for three-piece cans with a large amount of deformation during forming of a can body, two-piece cans where a few percent of a bottom portion is deformed, and can lids.

The invention claimed is:

1. A steel sheet for cans, comprising a chemical composition containing, in mass %, C: 0.010% or more and 0.130% or less, Si: 0.04% or less, Mn: 0.10% or more and 1.00% or less, P: 0.007% or more and 0.100% or less, S: 0.0005% or more and 0.0090% or less, Al: 0.001% or more and 0.100% or less, N: 0.0050% or less, Ti: 0.0050% or more and 0.1000% or less, B: 0.0005% or more and less than 0.0020%, and Cr: 0.001% or more and 0.08% or less, wherein, with $Ti^*=Ti-1.5S$, $0.005 \leq (Ti^*/48)/(C/12) \leq 0.700$ is satisfied, and the balance is Fe and inevitable impurities; and a microstructure with a proportion of non-recrystallized ferrite of 3% or less, wherein an upper yield stress is 550 MPa or more and 620 MPa or less.

2. The steel sheet for cans according to claim 1, wherein the chemical composition further contains, in mass %, at least one selected from the group consisting of Nb: 0.0050% or more and 0.0500% or less, Mo: 0.0050% or more and 0.0500% or less, and V: 0.0050% or more and 0.0500% or less.

3. A method of producing the steel sheet for cans of claim 1, comprising a hot rolling process wherein a steel slab comprising a chemical composition containing, in mass %, C: 0.010% or more and 0.130% or less, Si: 0.04% or less, Mn: 0.10% or more and 1.00% or less, P: 0.007% or more and 0.100% or less, S: 0.0005% or more and 0.0090% or less, Al: 0.001% or more and 0.100% or less, N: 0.0050% or less, Ti: 0.0050% or more and 0.1000% or less, B: 0.0005% or more and less than 0.0020%, and Cr: 0.001% or more and 0.08% or less, where, with $Ti^*=Ti-1.5S$, $0.005 \leq (Ti^*/48)/(C/12) \leq 0.700$ is satisfied, and the balance is Fe and inevitable impurities, is heated at 1200° C. or higher and subjected to rolling with a rolling finish temperature of 850° C. or higher to obtain a steel sheet, and the steel sheet is subjected to coiling at a temperature of 640° C. or higher and 780° C. or lower and then cooled at an average cooling rate of 25° C./h or higher and 55° C./h or lower from 500° C. to 300° C.; a cold rolling process wherein the steel sheet after the hot rolling process is subjected to cold rolling at rolling reduction of 86% or more; an annealing process wherein the steel sheet after the cold rolling process is held in a temperature range of 640° C. or higher and 780° C. or lower for 10 seconds or longer and 90 seconds or shorter, then the steel sheet is subjected to primary cooling to a temperature range of 500° C. or higher and 600° C. or lower at an average cooling rate of 7° C./s or higher and 180° C./s or lower, and subsequently the steel sheet is subjected to secondary cooling to 300° C. or lower at an average cooling rate of 0.1° C./s or higher and 10° C./s or lower; and a process wherein the steel sheet after the annealing process is subjected to temper rolling with rolling reduction of 0.1% or more and 3.0% or less.

4. The method of producing a steel sheet for cans according to claim 3, wherein the chemical composition further contains, in mass %, at least one selected from the group consisting of Nb: 0.0050% or more and 0.0500% or less, Mo: 0.0050% or more and 0.0500% or less, and V: 0.0050% or more and 0.0500% or less.

* * * * *